US010096280B2

(12) United States Patent
Wang et al.

(10) Patent No.: US 10,096,280 B2
(45) Date of Patent: Oct. 9, 2018

(54) DISPLAY DRIVING METHOD, DISPLAY DRIVING DEVICE AND DISPLAY DEVICE

(71) Applicants: BOE Technology Group Co., Ltd., Beijing (CN); Beijing BOE Optoelectronics Technology Co., Ltd., Beijing (CN)

(72) Inventors: Di Wang, Beijing (CN); Hao Zhang, Beijing (CN); Lingyun Shi, Beijing (CN); Xue Dong, Beijing (CN); Quanhua He, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 0 days.

(21) Appl. No.: 15/326,123

(22) PCT Filed: Feb. 16, 2016

(86) PCT No.: PCT/CN2016/073840

§ 371 (c)(1),
(2) Date: Jan. 13, 2017

(87) PCT Pub. No.: WO2017/041437

PCT Pub. Date: Mar. 16, 2017

(65) Prior Publication Data

US 2017/0229057 A1 Aug. 10, 2017

(30) Foreign Application Priority Data

Sep. 10, 2015 (CN) ..... 2015 1 0575081

(51) Int. Cl.
*G09G 3/20* (2006.01)

(52) U.S. Cl.
CPC ..... *G09G 3/2092* (2013.01); *G09G 3/2003* (2013.01); *G09G 3/2011* (2013.01);
(Continued)

(58) Field of Classification Search
CPC .. G09G 3/2092; G09G 3/2011; G09G 3/2003; G09G 3/2074; G09G 2330/021;
(Continued)

(56) References Cited

U.S. PATENT DOCUMENTS

2009/0002296 A1* 1/2009 Matsuura ..... G09G 3/3648 345/87
2010/0188374 A1* 7/2010 Chen ..... G09G 3/3614 345/204
2014/0028859 A1 1/2014 Kim et al.

FOREIGN PATENT DOCUMENTS

CN 1670596 A 9/2005
CN 103413533 A 11/2013
(Continued)

OTHER PUBLICATIONS

May 30, 2016—International Search Report and Written Opinion Appn PCT/CN2016/073840 with Eng Tran.

*Primary Examiner* — Carolyn R Edwards
*Assistant Examiner* — Saifeldin Elnafia
(74) *Attorney, Agent, or Firm* — Banner & Witcoff, Ltd.

(57) ABSTRACT

A display driving method, a display driving device and a display device are provided. The display driving method includes: detecting corresponding voltage change degrees of a display panel when the display panel adopts different wiring approaches to display an image to be displayed; comparing the detected voltage change degrees to obtain a minimum voltage change degree; and controlling the display panel to adopt a wiring approach corresponding to the obtained minimum voltage change degree, and displaying the image to be displayed using source voltages correspond-
(Continued)

ing to the wiring approach. A display panel in the disclosure can display images of different types with low power consumption, and hence the power consumption of the display panel can be greatly reduced.

20 Claims, 3 Drawing Sheets

(52) U.S. Cl.
CPC ..... *G09G 3/2074* (2013.01); *G09G 3/2077* (2013.01); *G09G 3/2081* (2013.01); *G09G 2300/023* (2013.01); *G09G 2300/0413* (2013.01); *G09G 2300/0443* (2013.01); *G09G 2330/021* (2013.01)

(58) Field of Classification Search
CPC ..... G09G 3/2077; G09G 3/2081; G09G 2300/023; G09G 2300/0413; G09G 2300/0443
See application file for complete search history.

(56) References Cited

FOREIGN PATENT DOCUMENTS

| | | | |
|---|---|---|---|
| CN | 104880840 | A | 9/2015 |
| CN | 105047123 | A | 11/2015 |

* cited by examiner

DISPLAY DRIVING METHOD, DISPLAY DRIVING DEVICE AND DISPLAY DEVICE

The application is a U.S. National Phase Entry of International Application No. PCT/CN2016/073840 filed on Feb. 16, 2016, designating the United States of America and claiming priority to Chinese Patent Application No. 201510575081.2 filed Sep. 10, 2015. The present application claims priority to and the benefit of the above-identified applications and the above-identified applications are incorporated by reference herein in their entirety.

TECHNICAL FIELD

The present disclosure relates to the field of display technology, in particular to a display driving method, a display driving device and a display device.

BACKGROUND

Currently, in the driving process of a display panel, by adoption of the BV3 algorithm, the number of source lines can be reduced and the resolution can be improved. However, the BV3 algorithm can only achieve good display effect by adoption of special wiring approaches on the display panel.

There are two wiring approaches in existing technologies. A first wiring approach is that each source line in the display panel is connected with subpixels of different colors, and a second wiring approach is that each source line in the display panel is connected with subpixels of the same color. If the first wiring approach is adopted, the display panel has low power consumption when displaying a pure color image and has high power consumption when displaying other images; and if the second wiring approach is adopted, the display panel has low power consumption when displaying other images and has high power consumption when displaying a pure color image. Therefore, there is no solution in the existing technologies such that the display panel can have low power consumption when displaying images of different types.

SUMMARY

The present disclosure provides a display driving method, a display driving device and a display device, so that a display panel can display images of different types with low power consumption, and hence the power consumption of the display panel can be reduced.

In order to achieve the above goal, the present disclosure provides a display driving method, including:

detecting corresponding voltage change degrees of a display panel when the display panel adopts different wiring approaches to display an image to be displayed;

comparing the detected voltage change degrees to obtain a minimum voltage change degree; and controlling the display panel to adopt a wiring approach corresponding to the obtained minimum voltage change degree, and displaying the image to be displayed using source voltages corresponding to the wiring approach.

For example, the display panel includes a plurality of wiring layers, the wiring layers are insulated from each other, each of the wiring layers corresponds to a different wiring approach, and the display panel is capable of making selection from the plurality of wiring layers.

For example, the wiring approaches include a first wiring approach and a second wiring approach;

the step of detecting corresponding voltage change degrees of the display panel when the display panel adopts different wiring approaches to display the image to be displayed includes: detecting a corresponding first voltage change degree when the display panel adopts the first wiring approach to display the image to be displayed, and detecting a corresponding second voltage change degree when the display panel adopts the second wiring approach to display the image to be displayed;

the step of comparing the detected voltage change degrees includes: comparing the first voltage change degree with the second voltage change degree, and obtaining a smaller voltage change degree from the first voltage change degree and the second voltage change degree; and the step of controlling the display panel to adopt the wiring approach corresponding to the obtained minimum voltage change degree and displaying the image to be displayed using the source voltages corresponding to the wiring approach includes:

if the second voltage change degree is the smaller voltage change degree of the first voltage change degree and the second voltage change degree after comparison, controlling the display panel to adopt the second wiring approach and displaying the image to be displayed using source voltages corresponding to the second wiring approach; or if the first voltage change degree is the smaller voltage change degree of the first voltage change degree and the second voltage change degree after comparison, controlling the display panel to adopt the first wiring approach and displaying the image to be displayed using source voltages corresponding to the first wiring approach.

For example, in the first wiring approach, each source line in the display panel is connected with subpixels of different colors; and in the second wiring approach, each source line in the display panel is connected with subpixels of a same color.

For example, each of the voltage change degrees includes: a source-voltage inversion frequency and a source-voltage inversion amplitude.

For example, the step of comparing the detected voltage change degrees to obtain the minimum voltage change degree includes:

comparing corresponding source-voltage inversion frequencies when the display panel adopts the different wiring approaches to display the image to be displayed, and taking a minimum of the source-voltage inversion frequencies as the minimum voltage change degree; or if the minimum of the source-voltage inversion frequencies cannot be obtained by comparing the corresponding source-voltage inversion frequencies when the display panel adopts the different wiring approaches to display the image to be displayed, further comparing corresponding source-voltage inversion amplitudes when the display panel adopts the different wiring approaches to display the image to be displayed, and taking a minimum of the source-voltage inversion amplitudes as the minimum voltage change degree.

In order to achieve the above goal, the present disclosure provides a display driving device, including:

a detection module configured to detect corresponding voltage change degrees of a display panel when the display panel adopts different wiring approaches to display an image to be displayed;

a comparison module configured to compare the detected voltage change degrees to obtain a minimum voltage change degree;

an output module configured to output a signal that indicates a wiring approach corresponding to the obtained minimum voltage change degree and to output source voltages corresponding to the wiring approach; and a driver module configured to control the display panel to adopt the wiring approach corresponding to the minimum voltage change degree according to the signal outputted by the output module, and to display the image to be displayed using the source voltages that correspond to the wiring approach and are outputted by the output module.

For example, the display panel includes a plurality of wiring layers, the wiring layers are insulated from each other; each of the wiring layers corresponds to a different wiring approach; and the display panel is capable of making selection from the plurality of wiring layers.

For example, the wiring approaches includes a first wiring approach and a second wiring approach;

the detection module is configured to detect a corresponding first voltage change degree when the display panel adopts the first wiring approach to display the image to be displayed, and detect a corresponding second voltage change degree when the display panel adopts the second wiring approach to display the image to be displayed;

the comparison module is configured to compare the first voltage change degree with the second voltage change degree, and obtain a smaller voltage change degree from the first voltage change degree and the second voltage change degree;

the output module is configured to output a signal that indicates a wiring approach corresponding to the smaller voltage change degree of the first voltage change degree and the second voltage change degree and to output source voltages corresponding to the wiring approach; and the driver module is configured to:

control the display panel to adopt the second wiring approach when the signal outputted by the output module indicates that the second wiring approach corresponds to the smaller voltage change degree of the first voltage change degree and the second voltage change degree, and display the image to be displayed using source voltages corresponding to the second wiring approach; or control the display panel to adopt the first wiring approach when the signal outputted by the output module indicates that the first wiring approach corresponds to the smaller voltage change degree of the first voltage change degree and the second voltage change degree, and display the image to be displayed using source voltages corresponding to the first wiring approach.

For example, in the first wiring approach, each source line in the display panel is connected with subpixels of different colors; and in the second wiring approach, each source line in the display panel is connected with subpixels of a same color.

For example, each of the voltage change degrees includes: a source-voltage inversion frequency and a source-voltage inversion amplitude.

For example, the detection module, the comparison module and the output module are integrated into an application processor.

For example, the driver module includes:

a switching sub-module configured to control the display panel to adopt the wiring approach corresponding to the minimum voltage change degree based on the signal outputted by the output module; and a driving sub-module configured to display the image to be displayed using the source voltages outputted by the output module that correspond to the wiring approach.

In order to achieve the above goal, the present disclosure provides a display device, comprising: a display panel and the display driving device described above;

the display panel includes a plurality of wiring layers; the wiring layers are insulated from each other; each of the wiring layers corresponds to a different wiring approach; and the display panel makes selection from the plurality of wiring layers.

For example, the different wiring layers include a first wiring layer and a second wiring layer; the first wiring layer corresponds to a first wiring approach; the second wiring layer corresponds to a second wiring approach; and the display driving device adopts the display driving device described above.

The advantages of the present disclosure include:

In the display driving method, the display driving device and the display device provided by the present disclosure, when the display panel adopts different wiring approaches to display the image to be displayed, corresponding voltage change degrees are detected; a minimum voltage change degree is obtained after comparison; and subsequently, the display panel is controlled to adopt a wiring approach corresponding to the minimum voltage change degree, and the image to be displayed is displayed using source voltages corresponding to the wiring approach. Thus, the display panel can display images of different types with low power consumption, and hence the power consumption of the display panel can be greatly reduced.

DETAILED DESCRIPTION

For more clear understanding of the technical proposals of the present disclosure, detailed description will be given below to the display driving method, the display driving device and the display device, provided by the present disclosure, with reference to the accompanying drawings.

Figure 1:
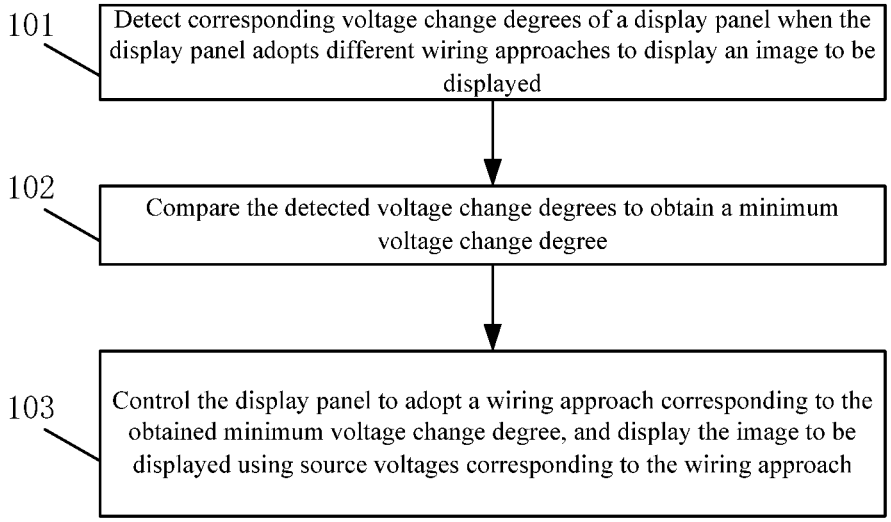
FIG. 1 is a flowchart of a display driving method provided by a first embodiment of the present disclosure.

FIG. 1 is a flowchart of a display driving method provided by a first embodiment of the present disclosure. As illustrated in FIG. 1, the method comprises the steps S101 to S103.

Step S101: detecting corresponding voltage change degrees of a display panel when the display panel adopts different wiring approaches to display an image to be displayed.

In the embodiment, the display panel includes a plurality of wiring layers; the wiring layers are insulated from each other; each wiring layer corresponds to a different wiring approach; and the display panel can select any wiring layer among the plurality of wiring layers, so that the display panel can switch among the plurality of wiring approaches. For example, a wiring approach refers to an approach by which source lines are connected with subpixels. When the display panel adopts a different wiring approach to display the image to be displayed, a corresponding voltage change degree is different. Correspondingly, the power consumption is also different when the display panel adopts a different wiring approach to display the image to be displayed. When the voltage change degree is smaller, the power consumption is lower. Therefore, before determining to adopt which wiring approach, the step S101 may be executed at first. Preferably, a voltage change degree includes: a source-voltage inversion frequency and a source-voltage inversion amplitude. An image to be displayed may include one frame or a plurality of frames. Before the step S101 is executed, source voltages used to display one frame of the image to be displayed when different wiring approaches are adopted to display the image may be pre-generated, and subsequently, a source-voltage inversion frequency and a source-voltage inversion amplitude when the frame is displayed are detected. Specifically, the source-voltage inversion frequency is the sum of inversion frequencies of source voltages on all the source lines when the frame is displayed. The source-voltage inversion amplitude is the sum of absolute values of the difference values of source voltages on all the source lines before and after each inversion of the source voltages when the frame is displayed. Therefore, in the detection process of the step S101, an inversion frequency of a source voltage on each source line may be detected, and subsequently, inversion frequencies of source voltages on all source lines when one frame is displayed are summed up to obtain the sum of the inversion frequencies of the source voltages on all the source lines; that is, the source-voltage inversion frequency when the image to be displayed is displayed is detected as the sum of the inversion frequencies of the source voltages on all the source lines. In addition, for each inversion of the source voltage on each source line, an absolute value of a difference of the source voltage before and after each inversion of the source voltage on the source line may be detected; then for each source line, the absolute value of the difference of the source voltage before and after each inversion of the source voltage on the source line is summed up to obtain the sum of the absolute values of the differences of the source voltage before and after inversions of the source voltage on the source line. Subsequently, for all the source lines, the sum of the absolute values of the differences of the source voltage before and after inversions of the source voltage on each source line is summed up to obtain the sum of the absolute values of the differences of the source voltages before and after inversions of the source voltages on all the source lines; that is, the source-voltage inversion amplitude when the image to be displayed is displayed is detected as the sum of the absolute values of the differences of the source voltages before and after all the inversions of the source voltages on all the source lines.

Step S102: comparing the detected voltage change degrees to obtain a minimum voltage change degree.

In the embodiment, one image to be displayed may include one frame or a plurality of frames. Therefore, preferably, the steps S101 and S102 may be executed when the last frame of the image to be displayed is displayed.

The step of comparing the detected voltage change degrees includes: comparing corresponding source-voltage inversion frequencies when the display panel adopts different wiring approaches to display the image to be displayed; and/or comparing corresponding source-voltage inversion amplitudes when the display panel adopts different wiring approaches to display the image to be displayed. If the corresponding source-voltage inversion frequencies when the display panel adopts the different wiring approaches to display the image to be displayed are the same, the corresponding source-voltage inversion amplitudes when the display panel adopts the different wiring approaches to display the image to be displayed can be further compared.

Correspondingly, a minimum of the source-voltage inversion frequencies is obtained by comparing the corresponding source-voltage inversion frequencies when the display panel adopts different wiring approaches to display the image to be displayed, and hence the minimum voltage change degree is obtained as the minimum of the source-voltage inversion frequencies. In a case that the minimum of the source-voltage inversion frequencies cannot be obtained by comparing the corresponding source-voltage inversion frequencies, a minimum of the source-voltage inversion amplitudes is obtained by further comparing the corresponding source-voltage inversion amplitudes when the display panel adopts different wiring approaches to display the image to be displayed, and hence the minimum voltage change degree is obtained as the minimum of the source-voltage inversion amplitudes.

As the power consumption is lower when the voltage change degree is smaller, the power consumption of the display panel can be reduced by obtaining the minimum voltage change degree after comparing the detected voltage change degrees.

Step S103: controlling the display panel to adopt a wiring approach corresponding to the obtained minimum voltage change degree, and displaying the image to be displayed using source voltages corresponding to the wiring approach.

When the same image to be displayed is displayed, the source voltages corresponding to different wiring approaches are different. In this step, the wiring approach corresponding to the minimum voltage change degree is selected and the source voltages corresponding to the wiring approach is selected.

In the display driving method provided by the present disclosure, corresponding voltage change degrees when the display panel adopts different wiring approaches to display the image to be displayed are detected; a minimum voltage change degree is obtained by comparing the corresponding voltage change degrees; and subsequently, the display panel is controlled to adopt a wiring approach corresponding to the minimum voltage change degree, and the image to be displayed is displayed using the source voltages corresponding to the wiring approach. As a result, the display panel can display images of different types in low power consumption, and hence the power consumption of the display panel can be greatly reduced.

Figure 2:
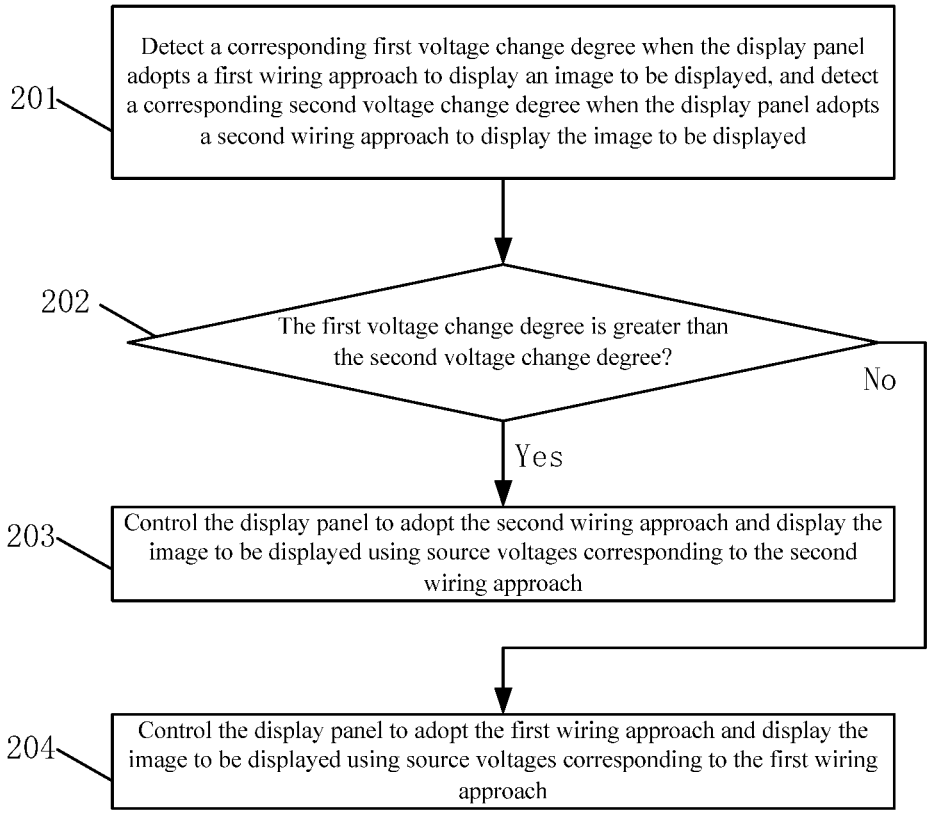
FIG. 2 is a flowchart of a display driving method provided by a second embodiment of the present disclosure.

FIG. 2 is a flowchart of a display driving method provided by a second embodiment. In the second embodiment, two wiring approaches, which are respectively referred to as a first wiring approach and a second wiring approach, are involved. Specifically, the display panel includes two wiring layers which are insulated from each other, in which one wiring layer corresponds to the first wiring approach and the other wiring layer corresponds to the second wiring layer.

As illustrated in FIG. 2, the display driving method provided by the embodiment includes steps S201 to S204.

Step S201: detecting a corresponding first voltage change degree when the display panel adopts the first wiring approach to display an image to be displayed, and detecting a corresponding second voltage change degree when the display panel adopts the second wiring approach to display the image to be displayed.

Figure 3:
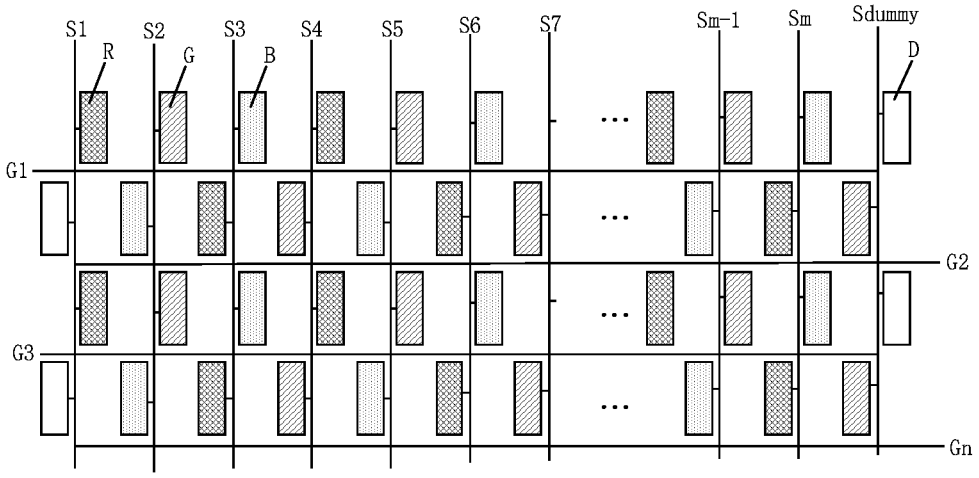
FIG. 3 is a schematic diagram of a first wiring approach of a display panel in the second embodiment.

FIG. 3 is a schematic diagram of the first wiring approach of the display panel in the second embodiment. As illustrated in FIG. 3, in the first wiring approach, each source line in the display panel is connected with subpixels of different colors. The display panel includes a plurality of gate lines and a plurality of source lines; the gate lines and the source lines are intercrossed with each other to define pixel units; and subpixels are disposed in the pixel units. In FIG. 3, the plurality of gate lines includes gate lines G1, G2, . . . , Gn, and the plurality of source lines includes source lines S1, S2, . . . , Sm, Sdummy, where the source line Sdummy is a dummy line. Subpixels of three colors are disposed in the pixel units. The subpixels of three colors are red subpixels R, green subpixels G and blue subpixels B. In addition, dummy electrodes D are disposed on the periphery of the display panel. The source line S1 is connected with red subpixels R and dummy electrodes D; the source line S2 is connected with green subpixels G and blue subpixels B; the source line S3 is connected with blue subpixels B and red subpixels R; similarly, the source line Sm is connected with blue subpixels B and red subpixels R; and the source line Sdummy is connected with green subpixels G and dummy electrodes D.

Figure 4:
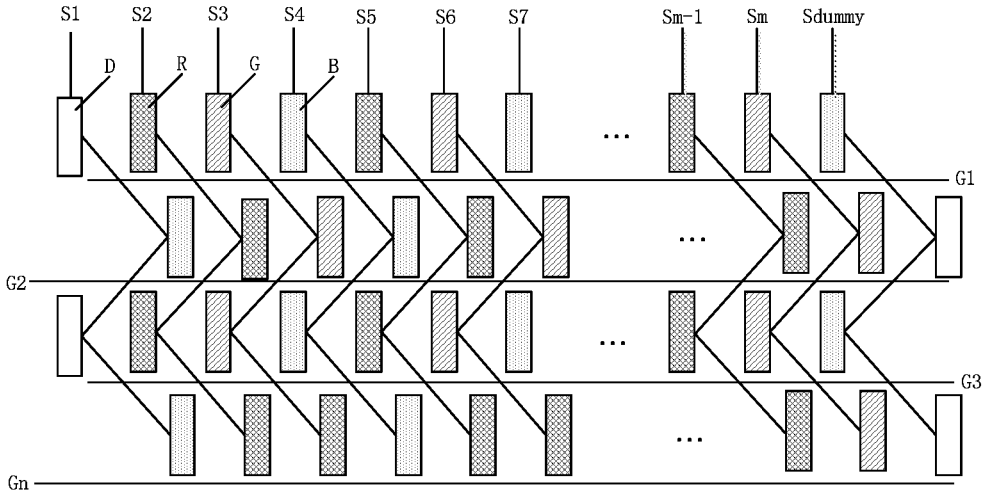
FIG. 4 is a schematic diagram of a second wiring approach of the display panel in the second embodiment.

FIG. 4 is a schematic diagram of the second wiring approach of the display panel in the second embodiment. As illustrated in FIG. 4, in the second wiring approach, each source line in the display panel is connected with subpixels of the same color. The display panel includes a plurality of gate lines and a plurality of source lines; the gate lines and the source lines are intercrossed with each other to define pixel units; and subpixels are disposed in the pixel units. In FIG. 4, the plurality of gate lines includes gate lines G1, G2, . . . , Gn, and the plurality of source lines includes source lines S1, S2, . . . , Sm, Sdummy, where the source line Sdummy may be taken as a dummy line. Subpixels of three colors are disposed in the pixel units. The subpixels of three colors are red subpixels R, green subpixels G and blue subpixels B. In addition, dummy electrodes D are disposed on the periphery of the display panel. The source line S1 is connected with dummy electrodes D and blue subpixels B; the source line S2 is connected with red subpixels R; the source line S3 is connected with green subpixels G; the source line S4 is connected with blue subpixels B; similarly, the source line Sm is connected with green subpixels G; and the source line Sdummy is connected with blue subpixels B and dummy electrodes D.

A voltage change degree may include: a source-voltage inversion frequency and a source-voltage inversion amplitude. Correspondingly, in the embodiment, the first voltage change degree may include: a first source-voltage inversion frequency and a first source-voltage inversion amplitude; and the second voltage change degree may include: a second source-voltage inversion frequency and a second source-voltage inversion amplitude. Specifically, the step S201 includes: detecting a corresponding first source-voltage inversion frequency and a corresponding first source-voltage inversion amplitude when the display panel adopts the first wiring approach to display the image to be displayed, and detecting a corresponding second source-voltage inversion frequency and a corresponding second source-voltage inversion amplitude when the display panel adopts the second wiring approach to display the image to be displayed.

S202: comparing the first voltage change degree with the second voltage change degree; if the first voltage change degree is larger than the second voltage change degree after comparison, then executing the step S203; and if the first voltage change degree is smaller than the second voltage change degree after comparison, then executing the step S204.

The step S202 specifically includes: comparing the first source-voltage inversion frequency with the second source-voltage inversion frequency; if the first source-voltage inversion frequency is greater than the second source-voltage inversion frequency after comparison, then it indicates that the first voltage change degree is larger than the second voltage change degree; if the first source-voltage inversion frequency is lower than the second source-voltage inversion frequency after comparison, then it indicates that the first voltage change degree is smaller than the second voltage change degree; if the first source-voltage inversion frequency is equal to the second source-voltage inversion frequency after comparison, the first source-voltage inversion amplitude and the second source-voltage inversion amplitude are further compared; if the first source-voltage inversion amplitude is greater than the second source-voltage inversion amplitude after comparison, then it indicates that the first voltage change degree is larger than the second voltage change degree; and if the first source-voltage inversion amplitude is less than the second source-voltage inversion amplitude after comparison, then it indicates that the first voltage change degree is smaller than the second voltage change degree.

S203: controlling the display panel to adopt the second wiring approach, displaying the image to be displayed with source voltages corresponding to the second wiring approach, and ending the process.

When the first voltage change degree is greater than the second voltage change degree after comparison, it indicates that the power consumption is smaller when the display panel adopts the second wiring approach to display the image to be displayed. Thus, the display panel is controlled to adopt the second wiring approach corresponding to the second voltage change degree, and the image to be displayed is displayed using the source voltages corresponding to the second wiring approach.

A power consumption of the display panel when displaying the image to be displayed includes a dynamic power consumption $P_D$ and a static power consumption $P_S$. For example, the static power consumption $P_S$ is mainly the power consumption caused by a leakage current; the leakage current includes a sub-threshold leakage current, a gate leakage current and a reverse-biased source leakage current; as the leakage current cannot be avoided, the static power consumption cannot be prevented as well. The dynamic power consumption $P_D$ includes a direct current (DC) switching power consumption $P_d$ and a load capacitance power consumption $P_L$ (namely $P_D=P_d+P_L$). The embodiments can reduce the power consumption of the display panel when displaying the image to be displayed by reducing the dynamic power consumption. A computation formula of the DC switching power consumption is $P_d=\alpha\cdot f\cdot C\cdot V^2$, in which $\alpha$ refers to a switching coefficient (the number of elements having state changes in each clock cycle), C refers to a load capacitance of the display panel, f refers to an operating frequency (e.g., 60 Hz) of a driving circuit, and V refers to an operating voltage of the driving circuit (namely the source voltage). It can be seen from the computation formula of the DC switching power consumption, as f and C are predetermined parameters, $P_d$ is directly proportional to $\alpha\cdot V^2$. The computation formula of the load capacitance power consumption is $P_L=VI$, in which I refers to a current flowing through thin-film transistors (TFTs).

In summary, the power consumption of the display panel when displaying the image to be displayed is $P=P_S+P_D=P_S+P_d+P_L$, in which the DC switching power consumption is $P_d=\alpha\cdot f\cdot C\cdot V^2$.

Description is given in the embodiment by taking the case that the image to be displayed is an R255 image (namely a pure red image) as an example.

Figure 5:
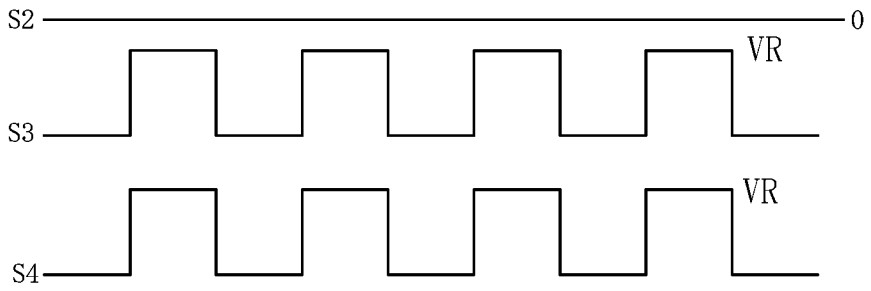
FIG. 5 is a schematic diagram of source voltages corresponding to the first wiring approach in FIG. 3.

FIG. 5 is a schematic diagram of source voltages corresponding to the first wiring approach in FIG. 3. As illustrated in FIGS. 3 and 5, if the R255 image is displayed, a DC switching power consumption $P_d$ of one pixel includes DC switching power consumptions of three subpixels. The DC switching power consumptions of the three subpixels are respectively $P_{d1}$, $P_{d2}$ and $P_{d3}$. Specifically, $P_{d1}$ refers to a DC switching power consumption of a subpixel connected with the source line S2; $P_{d2}$ refers to a DC switching power consumption of a subpixel connected with the source line S3; and $P_{d3}$ refers to a DC switching power consumption of a subpixel connected with the source line S4. $P_{d1}=\alpha\cdot f\cdot C\cdot(Vs1)^2=\alpha\cdot f\cdot C\cdot(0)^2=0$; $P_{d2}=\alpha\cdot f\cdot C\cdot(Vs2)^2=1280C\cdot(VR)^2$, $P_{d3}=\alpha\cdot f\cdot C\cdot(Vs3)^2=1280C\cdot(VR)^2$, in which Vs1, Vs2 and Vs3 are respectively source voltages on the source lines S2, S3 and S4. Therefore, the DC switching power consumption of one pixel may be obtained as: $P_d=P_{d1}+P_{d2}+P_{d3}=2560C\cdot(VR)^2$.

Figure 6:
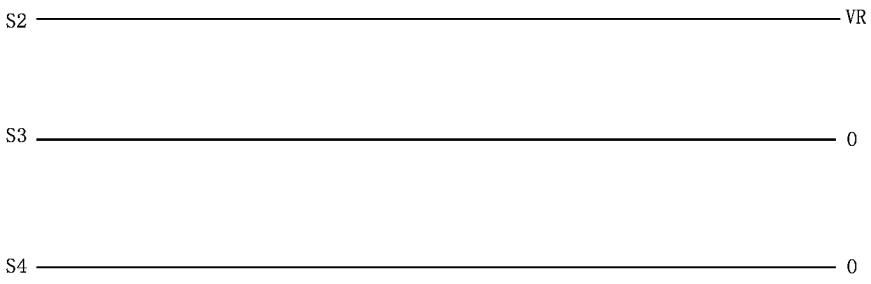
FIG. 6 is a schematic diagram of source voltages corresponding to the second wiring approach in FIG. 4.

FIG. 6 is a schematic diagram of source voltages corresponding to the second wiring approach in FIG. 4. As illustrated in FIGS. 4 and 6, if the R255 image is displayed, a DC switching power consumption $P_d$ of one pixel includes DC switching power consumptions of three subpixels. The DC switching power consumptions of the three subpixels are respectively $P_{d1}$, $P_{d2}$ and $P_{d3}$. Specifically, $d_{d1}$ refers to a DC switching power consumption of a subpixel connected with the source line S2; $P_d$ refers to a DC switching power consumption of a subpixel connected with the source line S3; and $P_{d3}$ refers to a DC switching power consumption of a subpixel connected with the source line S4. $P_{d1}=\alpha\cdot f\cdot C\cdot(Vs1)^2=\alpha\cdot f\cdot C\cdot(VR)^2=C\cdot(VR)^2$; $P_{d2}=\alpha\cdot f\cdot C\cdot(Vs2)^2=C\cdot(0)^2=0$; $P_{d3}=\alpha\cdot f\cdot C\cdot(Vs3)^2=C\cdot(0)^2=0$, where Vs1, Vs2 and Vs3 are respectively source voltages on the source lines S2, S3 and S4. Therefore, the DC switching power consumption of one pixel may be obtained as: $P_d=P_{d1}P_{d2}+P_{d3}=C\cdot(VR)^2$.

In summary, the DC switching power consumption $P_d$ of one pixel is $2560C\cdot(VR)^2$ when the first wiring approach in FIG. 3 is adopted, and the DC switching power consumption $P_d$ of one pixel is $C\cdot(VR)^2$ when the second wiring approach in FIG. 4 is adopted. Therefore, compared with the first wiring approach in FIG. 3, a power consumption of $2559C\cdot(VR)^2$ can be saved if the second wiring approach in FIG. 4 is adopted to display the R255 image. The DC switching power consumption $P_d$ only occupies one part of the total power consumption; however, when the power consumption saved due to the DC switching power consumption of each pixel is embodied to the entire display panel, the power consumption of the entire display panel can be greatly reduced. As the load capacitance power consumption $P_L$ is positively related to the DC switching power consumption $P_d$, when the DC switching power consumption $P_d$ is reduced, the load capacitance power consumption $P_L$ is also reduced. The DC switching power consumption $P_d$ and the load capacitance power consumption $P_L$ only occupy one part of the total power consumption; however, when the power consumption saved from the DC switching power consumption $P_d$ and the load capacitance power consumption $P_L$ of each pixel is embodied to the entire display panel, the power consumption of the entire display panel can be greatly reduced.

In the embodiment, the voltage change degree is related to the switching coefficient $\alpha$. When the voltage change degree is smaller, the switching coefficient $\alpha$ is reduced; and when the voltage change degree is larger, the switching coefficient $\alpha$ is increased. Therefore, the power consumption can be reduced when the wiring approach corresponding to a smaller voltage change degree is selected.

S204: controlling the display panel to adopt the first wiring approach, displaying the image to be displayed with source voltages corresponding to the first wiring approach, and ending the process.

When the first voltage change degree is smaller than the second voltage change degree after comparison, it indicates that the power consumption is lower when the display panel adopts the first wiring approach to display the image to be displayed. Therefore, the display panel is controlled to adopt the first wiring approach corresponding to the first voltage change degree, and the image to be displayed is displayed with source voltages corresponding to the first wiring approach.

In the display driving method provided by the embodiment, corresponding voltage change degrees when the display panel adopts different wiring approaches to display the image to be displayed are detected; a minimum voltage change degree is obtained by comparing the corresponding voltage change degrees; and subsequently, the display panel is controlled to adopt a wiring approach corresponding to the minimum voltage change degree, and the image to be displayed is displayed with source voltages corresponding to the wiring approach that corresponds to the minimum voltage change degree. Thus, the display panel can display images of different types in low power consumption, and hence the power consumption of the display panel can be greatly reduced.

Figure 7:
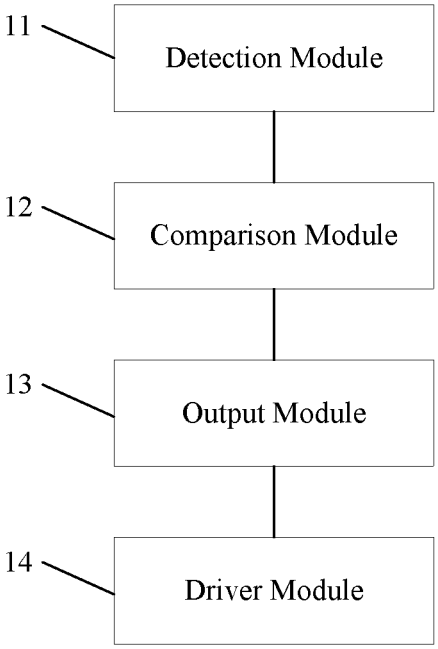
FIG. 7 is a schematic structural view of a display driving device provided by a third embodiment of the present disclosure.

FIG. 7 is a schematic structural view of a display driving device provided by a third embodiment of the present disclosure. In the embodiment, a display panel includes a plurality of wiring layers; the wiring layers are insulated from each other; and each wiring layer corresponds to a different wiring approach, so that the display panel can switch among a plurality of wiring approaches.

As illustrated in FIG. 7, the display driving device provided by the embodiment comprises: a detection module 11, a comparison module 12, an output module 13 and a driver module 14.

The detection module 11 is configured to detect corresponding voltage change degrees when the display panel adopts different wiring approaches to display an image to be displayed. The comparison module 12 is configured to compare the detected voltage change degrees to obtain a minimum voltage change degree. The output module 13 is configured to output a signal for indicating a wiring approach corresponding to the obtained minimum voltage change degree and to output source voltages corresponding to the wiring approach. The driver module 14 is configured to control the display panel to adopt the wiring approach corresponding to the minimum voltage change degree based on the signal outputted by the output module 13, and to display the image to be displayed with the source voltages that correspond to the wiring approach and are outputted by the output module 13.

Preferably, there are two wiring approaches in the display panel, which are respectively a first wiring approach and a second wiring approach. Specifically, the display panel includes two wiring layers which are insulated from each other, in which one wiring layer corresponds to the first wiring approach and the other wiring layer corresponds to the second wiring approach. The detection module 11 is specifically configured to detect a corresponding first voltage change degree when the display panel adopts the first wiring approach to display the image to be displayed, and detect a corresponding second voltage change degree when the display panel adopts the second wiring approach to display the image to be displayed. The comparison module 12 is specifically configured to compare the first voltage change degree with the second voltage change degree and obtain a smaller voltage change degree between the first voltage change degree and the second voltage change degree. The output module 13 is specifically configured to output a signal for indicating the wiring approach corresponding to the smaller voltage change degree and to output source voltages corresponding to the wiring approach. The driver module 14 is specifically configured to control the display panel to adopt the wiring approach corresponding to the smaller voltage change degree, and display the image to be displayed with the source voltages corresponding to the wiring approach that corresponds to the smaller voltage change degree.

Preferably, the detection module 11, the comparison module 12 and the output module 13 are integrated into an application processor (AP).

Preferably, the driver module 14 is integrated into a driver IC. Specifically, the driver module 14 may include: a switching sub-module 141 and a driving sub-module 142. The switching sub-module 141 is configured to control the display panel to adopt the wiring approach corresponding to the minimum voltage change degree. The driving sub-module 142 is configured to display the image to be displayed with the source voltages corresponding to the wiring approach. In the embodiment, the selection of the wiring approach of the display panel is controlled by the additional arrangement of the switching sub-module.

In the display driving device provided by the embodiment, corresponding voltage change degrees are detected when the display panel adopts different wiring approaches to display the image to be displayed; a minimum voltage change degree is obtained by comparison of the corresponding voltage change degrees; and subsequently, the display panel is controlled to adopt a wiring approach corresponding to the minimum voltage change degree, and the image to be displayed is displayed with the source voltages corresponding to the wiring approach. Thus, the display panel can display images of different types in low power consumption, and hence the power consumption of the display panel can be greatly reduced.

A fourth embodiment of the present disclosure provides a display device, which comprises: a display panel and a display driving device. The display panel includes a plurality of wiring layers; the wiring layers are insulated from each other; and each wiring layer corresponds to a different wiring approach.

The description on the display driving device may be referred to with the third embodiment. No further description will be given here.

In the display device provided by the embodiment, corresponding voltage change degrees are detected when the display panel adopts different wiring approaches to display the image to be displayed is detected; a minimum voltage change degree is obtained by comparison; and subsequently, the display panel is controlled to adopt a wiring approach corresponding to the minimum voltage change degree, and the image to be displayed is displayed with source voltages corresponding to the wiring approach. Thus, the display panel can display images of different types in low power consumption, and hence the power consumption of the display panel can be greatly reduced.

It should be understood that the above embodiments are only example embodiments adopted for illustrating the principle of the present disclosure and not intended to limit the present disclosure. Various modifications and improvements may be made by those skilled in the art without departing from the spirit and the essence of the present disclosure and shall also fall within the scope of protection of the present disclosure.

What is claimed is:

1. A display driving method, comprising:

detecting corresponding voltage change degrees of a display panel when the display panel adopts different wiring approaches to display an image to be displayed;

comparing the detected voltage change degrees to obtain a minimum voltage change degree from the detected voltage change degrees; and controlling the display panel to adopt a wiring approach corresponding to the obtained minimum voltage change degree, and displaying the image to be displayed using source voltages corresponding to the wiring approach, wherein:

each of the voltage change degrees includes a source-voltage inversion frequency; and the step of comparing the detected voltage change degrees to obtain the minimum voltage change degree includes: comparing corresponding source-voltage inversion frequencies when the display panel adopts the different wiring approaches to display the image to be displayed, and taking a minimum of the source-voltage inversion frequencies as the minimum voltage change degree.

2. The display driving method according to claim 1, wherein the display panel includes a plurality of wiring layers, the wiring layers are insulated from each other, each of the wiring layers corresponds to a different wiring approach, and the display panel is capable of making selection from the plurality of wiring layers.

3. The display driving method according to claim 1, wherein the different wiring approaches include a first wiring approach and a second wiring approach;

the step of detecting corresponding voltage change degrees of the display panel when the display panel adopts different wiring approaches to display the image to be displayed includes: detecting a corresponding first voltage change degree when the display panel adopts the first wiring approach to display the image to be displayed, and detecting a corresponding second voltage change degree when the display panel adopts the second wiring approach to display the image to be displayed;

the step of comparing the detected voltage change degrees includes: comparing the first voltage change degree with the second voltage change degree, and obtaining a smaller voltage change degree from the first voltage change degree and the second voltage change degree; and the step of controlling the display panel to adopt the wiring approach corresponding to the obtained minimum voltage change degree and displaying the image to be displayed using the source voltages corresponding to the wiring approach includes:

if the second voltage change degree is the smaller voltage change degree of the first voltage change degree and the second voltage change degree after comparison, controlling the display panel to adopt the second wiring approach and displaying the image to be displayed using source voltages corresponding to the second wiring approach; or if the first voltage change degree is the smaller voltage change degree of the first voltage change degree and the second voltage change degree after comparison, controlling the display panel to adopt the first wiring approach and displaying the image to be displayed using source voltages corresponding to the first wiring approach.

4. The display driving method according to claim 3, wherein in the first wiring approach, each source line in the display panel is connected with subpixels of different colors; and in the second wiring approach, each source line in the display panel is connected with subpixels of a same color.

5. The display driving method according to claim 1, wherein each of the voltage change degrees further includes: a source-voltage inversion amplitude.

6. The display driving method according to claim 5, wherein the step of comparing the detected voltage change degrees to obtain the minimum voltage change degree further includes:

if the minimum of the source-voltage inversion frequencies cannot be obtained by comparing the corresponding source-voltage inversion frequencies when the display panel adopts the different wiring approaches to display the image to be displayed, further comparing corresponding source-voltage inversion amplitudes when the display panel adopts the different wiring approaches to display the image to be displayed, and taking a minimum of the source-voltage inversion amplitudes as the minimum voltage change degree.

7. A display driving device, comprising:

a detection module configured to detect corresponding voltage change degrees of a display panel when the display panel adopts different wiring approaches to display an image to be displayed;

a comparison module configured to compare the detected voltage change degrees to obtain a minimum voltage change degree from the detected voltage change degrees;

an output module configured to output a signal that indicates a wiring approach corresponding to the obtained minimum voltage change degree and to output source voltages corresponding to the wiring approach; and a driver module configured to control the display panel to adopt the wiring approach corresponding to the minimum voltage change degree according to the signal outputted by the output module, and to display the image to be displayed using the source voltages that correspond to the wiring approach and are outputted by the output module, wherein:

each of the voltage change degrees includes a source-voltage inversion frequency; and the comparison module is further configured to: compare corresponding source-voltage inversion frequencies when the display panel adopts the different wiring approaches to display the image to be displayed, and take a minimum of the source-voltage inversion frequencies as the minimum voltage change degree.

8. The display driving device according to claim 7, wherein the display panel includes a plurality of wiring layers, the wiring layers are insulated from each other; each of the wiring layers corresponds to a different wiring approach; and the display panel is capable of making selection from the plurality of wiring layers.

9. The display driving device according to claim 7, wherein the different wiring approaches includes a first wiring approach and a second wiring approach;

the detection module is configured to detect a corresponding first voltage change degree when the display panel adopts the first wiring approach to display the image to be displayed, and detect a corresponding second voltage change degree when the display panel adopts the second wiring approach to display the image to be displayed;

the comparison module is configured to compare the first voltage change degree with the second voltage change degree, and obtain a smaller voltage change degree from the first voltage change degree and the second voltage change degree;

the output module is configured to output a signal that indicates a wiring approach corresponding to the smaller voltage change degree of the first voltage change degree and the second voltage change degree and to output source voltages corresponding to the wiring approach; and the driver module is configured to:

control the display panel to adopt the second wiring approach when the signal outputted by the output module indicates that the second wiring approach corresponds to the smaller voltage change degree of the first voltage change degree and the second voltage change degree, and display the image to be displayed using source voltages corresponding to the second wiring approach; or control the display panel to adopt the first wiring approach when the signal outputted by the output module indicates that the first wiring approach corresponds to the smaller voltage change degree of the first voltage change degree and the second voltage change degree, and display the image to be displayed using source voltages corresponding to the first wiring approach.

10. The display driving device according to claim 9, wherein in the first wiring approach, each source line in the display panel is connected with subpixels of different colors; and in the second wiring approach, each source line in the display panel is connected with subpixels of a same color.

11. The display driving device according to claim 7, wherein each of the voltage change degrees further includes: a source-voltage inversion amplitude.

12. The display driving device according to claim 7, wherein the detection module, the comparison module and the output module are integrated into an application processor.

13. The display driving device according to claim 7, wherein the driver module includes:

a switching sub-module configured to control the display panel to adopt the wiring approach corresponding to the minimum voltage change degree based on the signal outputted by the output module; and a driving sub-module configured to display the image to be displayed using the source voltages outputted by the output module that correspond to the wiring approach.

14. A display device, comprising: the display panel and the display driving device according to claim 7, wherein:

the display panel includes a plurality of wiring layers; the wiring layers are insulated from each other; each of the wiring layers corresponds to a different wiring approach; and the display panel makes selection from the plurality of wiring layers.

15. The display device according to claim 14, wherein the plurality of wiring layers include a first wiring layer and a second wiring layer; the first wiring layer corresponds to a first wiring approach; the second wiring layer corresponds to a second wiring approach; and the display driving device includes the detection module, the comparison module, the output module and the driver module;

the detection module is configured to detect a corresponding first voltage change degree when the display panel adopts the first wiring approach to display the image to be displayed, and detect a corresponding second voltage change degree when the display panel adopts the second wiring approach to display the image to be displayed;

the comparison module is configured to compare the first voltage change degree with the second voltage change degree, and obtain a smaller voltage change degree from the first voltage change degree and the second voltage change degree;

the output module is configured to output a signal that indicates a wiring approach corresponding to the smaller voltage change degree of the first voltage change degree and the second voltage change degree and to output source voltages corresponding to the wiring approach; and the driver module is configured to:

control the display panel to adopt the second wiring approach when the signal outputted by the output module indicates that the second wiring approach corresponds to the smaller voltage change degree of the first voltage change degree and the second voltage change degree, and display the image to be displayed using source voltages corresponding to the second wiring approach; or control the display panel to adopt the first wiring approach when the signal outputted by the output module indicates that the first wiring approach corresponds to the smaller voltage change degree of the first voltage change degree and the second voltage change degree, and display the image to be displayed using source voltages corresponding to the first wiring approach.

16. The display device according to claim 15, wherein in the first wiring approach, each source line in the display panel is connected with subpixels of different colors; and in the second wiring approach, each source line in the display panel is connected with subpixels of a same color.

17. A display driving method, comprising:

detecting corresponding voltage change degrees of a display panel when the display panel adopts different wiring approaches to display an image to be displayed;

comparing the detected voltage change degrees to obtain a minimum voltage change degree from the detected voltage change degrees; and controlling the display panel to adopt a wiring approach corresponding to the obtained minimum voltage change degree, and displaying the image to be displayed using source voltages corresponding to the wiring approach, wherein:

the different wiring approaches include a first wiring approach and a second wiring approach;

the step of detecting corresponding voltage change degrees of the display panel when the display panel adopts different wiring approaches to display the image to be displayed includes:

detecting a corresponding first voltage change degree when the display panel adopts the first wiring approach to display the image to be displayed, and detecting a corresponding second voltage change degree when the display panel adopts the second wiring approach to display the image to be displayed;

the step of comparing the detected voltage change degrees includes: comparing the first voltage change degree with the second voltage change degree, and obtaining a smaller voltage change degree from the first voltage change degree and the second voltage change degree;

the step of controlling the display panel to adopt the wiring approach corresponding to the obtained minimum voltage change degree and displaying the image to be displayed using the source voltages corresponding to the wiring approach includes:

if the second voltage change degree is the smaller voltage change degree of the first voltage change degree and the second voltage change degree after comparison, controlling the display panel to adopt the second wiring approach and displaying the image to be displayed using source voltages corresponding to the second wiring approach; or if the first voltage change degree is the smaller voltage change degree of the first voltage change degree and the second voltage change degree after comparison, controlling the display panel to adopt the first wiring approach and displaying the image to be displayed using source voltages corresponding to the first wiring approach; and in the first wiring approach, each source line in the display panel is connected with subpixels of different colors; and in the second wiring approach, each source line in the display panel is connected with subpixels of a same color.

18. The display driving method according to claim 17, wherein the display panel includes a plurality of wiring layers, the wiring layers are insulated from each other, each of the wiring layers corresponds to a different wiring approach, and the display panel is capable of making a selection from the plurality of wiring layers.

19. The display driving method according to claim 17, wherein each of the voltage change degrees includes: a source-voltage inversion frequency and a source-voltage inversion amplitude.

20. The display driving method according to claim 19, wherein the step of comparing the detected voltage change degrees to obtain the minimum voltage change degree includes:

comparing corresponding source-voltage inversion frequencies when the display panel adopts the different wiring approaches to display the image to be displayed, and taking a minimum of the source-voltage inversion frequencies as the minimum voltage change degree; or if the minimum of the source-voltage inversion frequencies cannot be obtained by comparing the corresponding source-voltage inversion frequencies when the display panel adopts the different wiring approaches to display the image to be displayed, further comparing corresponding source-voltage inversion amplitudes when the display panel adopts the different wiring approaches to display the image to be displayed, and taking a minimum of the source-voltage inversion amplitudes as the minimum voltage change degree.

* * * * *